United States Patent [19]

Parrish

[11] 4,369,849

[45] Jan. 25, 1983

[54] LARGE DIAMETER OIL WELL DRILLING BIT

[75] Inventor: John D. Parrish, Houston, Tex.

[73] Assignee: Reed Rock Bit Company, Houston, Tex.

[21] Appl. No.: 156,883

[22] Filed: Jun. 5, 1980

[51] Int. Cl.[3] ..... E21B 10/18; E21B 10/20

[52] U.S. Cl. ..... 175/340; 175/356; 175/366; 175/375; 76/108 A

[58] Field of Search ..... 175/339, 340, 375, 342, 175/356, 366; 76/101 E, 108 A

[56] References Cited

U.S. PATENT DOCUMENTS

| | | | |
|---|---|---|---|
| 2,124,521 | 7/1938 | Williams et al. | 175/366 |
| 2,151,348 | 3/1939 | Fisher | 175/356 |
| 2,318,370 | 5/1943 | Buvel | 175/356 |
| 2,648,526 | 8/1957 | Lanchester | 175/340 |
| 2,949,281 | 8/1960 | Bauer et al. | 175/340 X |
| 3,850,256 | 11/1974 | McQueen | 175/375 |
| 4,156,123 | 5/1979 | Fischer et al. | 175/375 |
| 4,158,973 | 6/1979 | Schumacher, Jr. | 76/108 A |
| 4,229,638 | 10/1980 | Lichte | 175/375 |

FOREIGN PATENT DOCUMENTS

| | | | |
|---|---|---|---|
| 936382 | 11/1955 | Fed. Rep. of Germany | 175/366 |

*Primary Examiner*—William F. Pate, III

*Attorney, Agent, or Firm*—Michael J. Caddell

[57] ABSTRACT

The present invention discloses a large diameter oil well drilling bit which utilizes a unique cast body upon which are secured a plurality of cutting assemblies comprising a leg, a bearing journal and a rolling cutter mounted on the bearing journal.

7 Claims, 8 Drawing Figures

FIG. 4
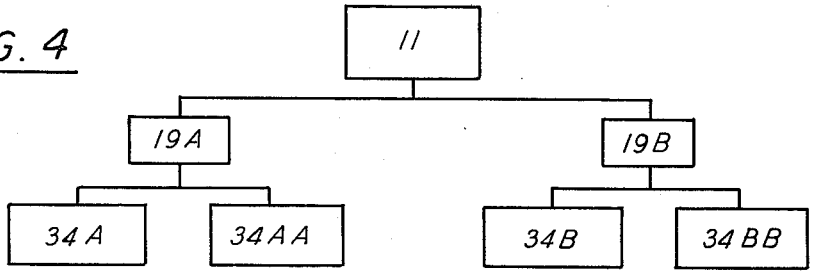
FIG. 5
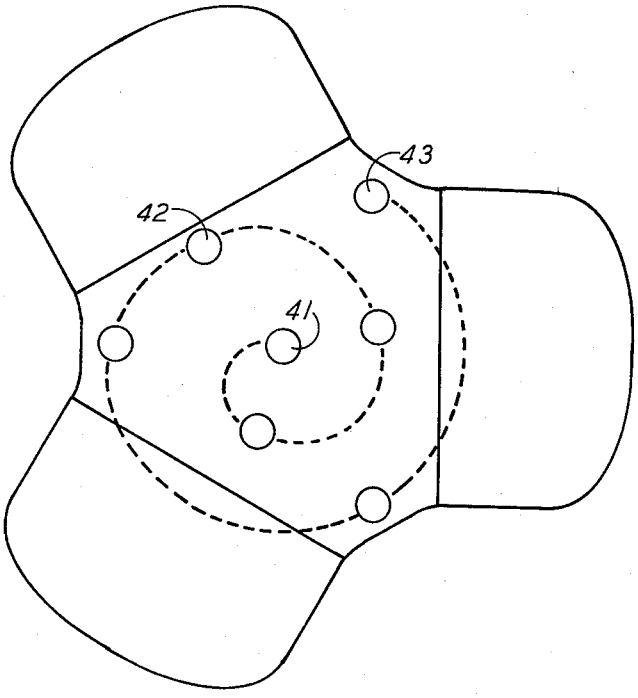
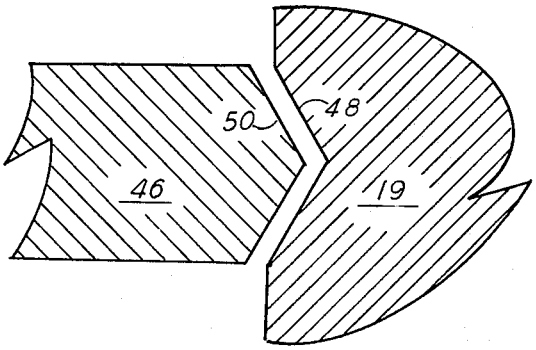
FIG. 6

LARGE DIAMETER OIL WELL DRILLING BIT

BACKGROUND OF THE INVENTION

The present invention generally involves oil well drilling bits, and more particularly discloses the large diameter drilling bits commonly termed, "top hole" bits used to drill the very first section of borehole beginning at the ground surface, and are also used for drilling casing openings. The top hole bits generally range in size from about 18 inches up to about 28 inches and are very cumbersome and heavy. Generally, top hole bits comprise either four-cutter bits commonly called, "cross cutter" bits, or else they comprise tri-cone rolling cutter bits such as that disclosed herein. The general method of manufacturing large tri-cone rolling cutter bits is in the segmented arc construction method. This method utilizes three 120-degree arcuate lug sections, each comprising one-third of the drill bit body and an individual leg portion with a bearing journal thereon. These three arcuate sections are usually forged and then machined to form the bearing surfaces on the bearing journals and the mating surfaces along each edge where the three sections are welded together. Prior to joining the three arcuate sections to form a cylindrical body, the cutter assembly with bearings and retention means must first be mounted on the inwardly projecting bearing journals because of the impossibility of so mounting the cutters after the three arcuate sections have been welded together.

After the bearing assemblies and cutters are mounted on the machined bearing journals, the three lugs are then placed in a welding jig and welded to each other to form the cylindrical bit body. After this welding has occurred a tapered thread is machined on the upper end of the bit, which tapered threaded end is commonly referred to as the "pin" end, and the bit is ready for use. The difficulties with this assembly method in manufacturing tophole or large diameter bits is that because of the size of these bits, minor variations and tolerances in alignments of the three lug sections results in substantial final errors in the bit specifications and dimensions. The forged lug sections of the prior art bits are relatively rough and inaccurate and the machining of the mating surfaces likewise is difficult to control to close tolerances. When the three lug sections are eventually welded together to form a single cylindrical structure with cutter assemblies already permanently mounted thereon, most often the results are that the cutters are not only non-concentric about the rotational axis of the bit, but the cutters also extend different distances downward from the pin end of the bit. Thus, one cutter may extend further downward than the other two and may provide almost all of the cutting action on the borehole bottom until that cutter is worn substantially to match the shorter two cutters. This tends to cause premature failure of either the bearings or the cutter shell on that one cutting assembly, which in turn will result in early failure of the bit. Likewise, radial placement of the lugs is difficult to control and may result in the drill bit cutting under gage, which is undesirable because of the borehole being smaller than necessary and smaller than specified. Also, if one cutter extends radially further outward than either one or both of the other cutters, a resulting effect could be "tracking" of the cutting teeth on the cutters and eventual gyration or orbiting action of the bit about the rotational axis thereby substantially eliminating the cutting efficiency of the bit.

The present invention eliminates these disadvantages found in the big diameter or top hole bits by providing a structure that is much more easily assembled and in which tolerances can be closely controlled during assembly of the bit. Further disclosure is made of a method of assembling the bit to provide extremely close tolerances in the radial and axial directions of the cutter assemblies. Also disclosed is a method of varying the offset of the cutter axes by relatively simple and inexpensive means during construction of the bit. The invention is achieved by utilizing a cast bit body which is formed in a single section and which has three platform areas formed thereon for receiving three independent cutter assemblies which are then welded to the cast iron body. Each cutter assembly has a countersunk alignment point which is engaged by the hydraulic or mechanical alignment tool which forms a part of this invention. The alignment tool fixes the cutter assemblies in place on the cast metal body whereupon they are welded in place to form a highly accurate, close tolerance, large diameter tri-cone drilling bit.

BRIEF DESCRIPTION OF THE DRAWINGS

FIG. 4 is a block diagram illustrating the interchangeability of parts throughout the bit and the assembly method for obtaining four different bit sizes.

FIG. 5 is a schematic axial view of the bit body illustrating the sweeping pattern of the nozzle system located thereon.

FIG. 6 is a schematic side view of the bit showing one cutter arm in place.

DESCRIPTION OF THE PREFERRED EMBODIMENTS

Figure 1:
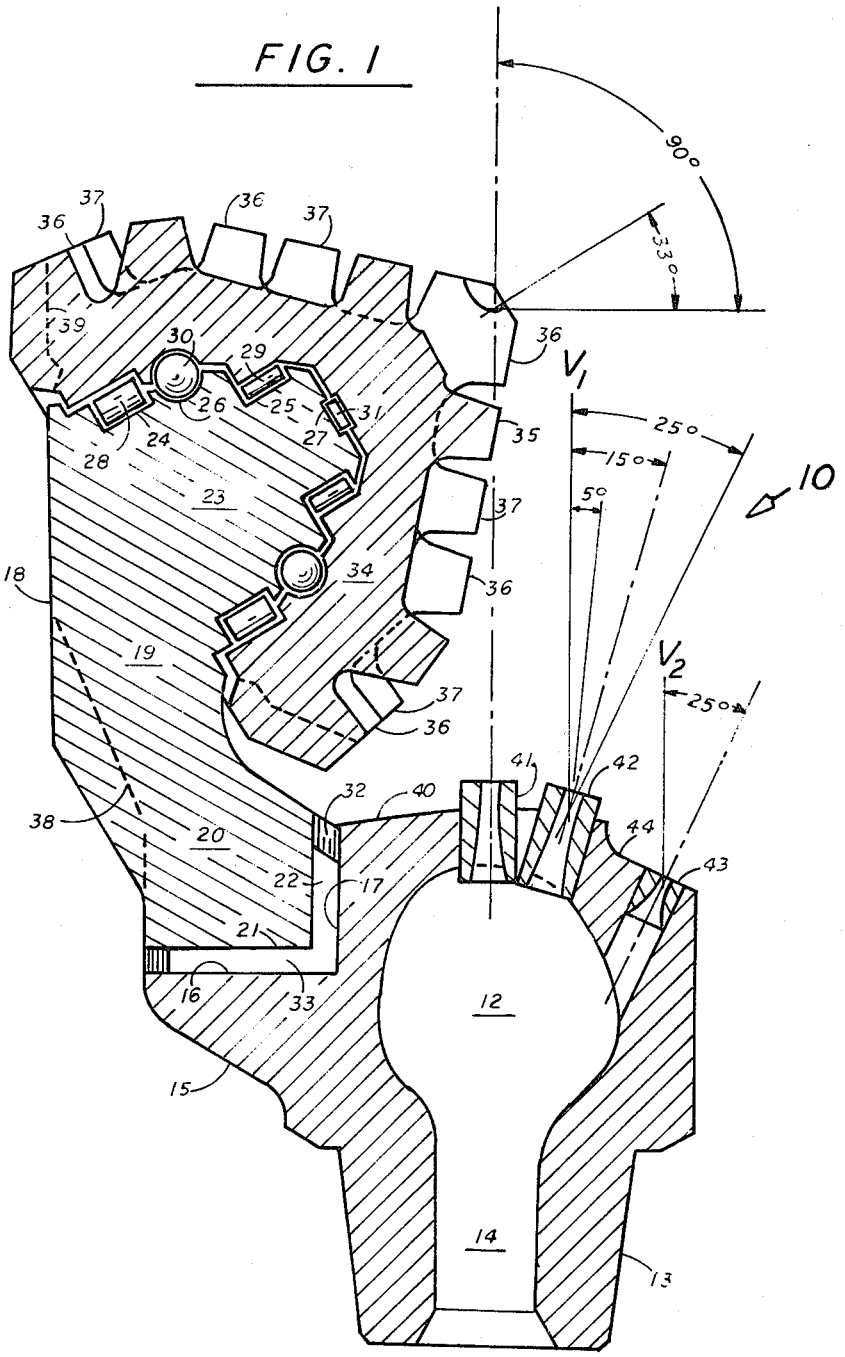
FIG. 1 is a side elevational view of the present invention showing the bit body and a typical cutter assembly in cross-sectional view.

Referring now to the figures, and more particularly to FIG. 1, a tri-cone, rolling cutter drill bit according to the present invention is partially disclosed in cross-sectional view in FIG. 1. FIG. 1 illustrates the body and a typical lug assembly attached to the body. In normal procedure a tri-cone bit, according to this invention, would comprise a body and three of the leg assemblies as shown attached to the body in relatively equidistant relationship around the body; i.e., at approximately 120-degree intervals. In FIG. 1, the tri-cone drill bit 10 comprises a single, integrally formed, steel body 11 having a central bore area 12 and a tapered pin section 13. Central bore 12 communicates through pin area 13 via pin bore 14. Three outwardly extending platforms 15 (only one shown) are integrally formed on body member 11 during the fabrication of the body member. Platform 15 generally comprises a relatively flat, upward-facing, mounting surface 16 and a relatively flat, vertical, shoulder abutment 17 joined with surface 16 to form an L-shaped mounting platform for the lug assembly 18.

In one particular embodiment of the present invention, the body member 11 was formed in a single operation by means of casting from suitable steel alloy. By utilizing selective casting techniques and extremely accurate casting, body member 11 can be obtained having a close-tolerance tapered section 13 and being close to tolerance on surfaces 16 and 17 of arm 15. In this particular embodiment, tapered pin 13 was accurate enough to provide alignment of the body member for final machining of surfaces 16 and 17 prior to attachment of lug assembly 18 thereto. The machining of surfaces 16 and 17, because of the accuracy of the casting techniques, generally needs only a minor bit of machine work to smooth up the area for abutment of leg assembly 18. Alternative to machining surfaces 16 and 17 off of the alignment with unfinished tapered pin 13 is to machine the final threaded portion on the external surface of pin 13, (which threaded surface is utilized to interconnect the drill bit with the drill string), and then threading the tapered end 13 into a female threaded alignment jig before machining surfaces 16 and 17.

The lug assembly 18 comprises a unitary lug member 19 which in this embodiment was formed in a forging operation. Lug 19 comprises leg section 20 having a L-shaped end with horizontal surface 21 and vertical surface 22. Surfaces 21 and 22 preferably are machined on leg section 20 to match surfaces 16 and 17 and provide proper alignment of leg assembly 18 on member 11. At the upper end of lug member 19 (as shown in FIG. 1), a compound bearing journal 23 is formed on the lug member during the forging operation and is final-machined to provide roller bearing surfaces 24 and 25. Also a ball bearing race 26 is formed on journal 23 as well as a thrust bearing recess 27. Alternatively, roller bearing races 24 and 25 could be replaced with friction bearing surfaces should the bit manufacturer wish to utilize sleeve-type friction bearings in place of the roller bearings as disclosed herein.

A plurality of roller bearings 28 are located in roller bearing recess 24 to substantially encircle bearing journal 23 and provide rotatable contact with the cutter mounted thereon. Likewise, a set of smaller roller bearings 29 are located in roller bearing recess 25. A plurality of ball bearings 30 are located in ball bearing race 26 to encircle bearing journal 23. A small, flat, circular thrust disc 31 is located in thrust recess area 27. Thrust disc 31 may be comprised of any suitable bearing material such as copper, steel or any of the softer metals such as lead, silver, indium; or may be formed of any combination of these elements. Roller bearings 28 and 29 and ball bearings 30 are preferably formed of a hard, tough metal alloy such as steel, which is suitable for receiving high loads without galling or spalling. Such alloys are well known in the art and not disclosed herein.

Each of the three lug members 19 are preferably located on platforms 15 of body member 11 and attached thereto by welding as shown in FIG. 1 at 32. Welding is performed along a weld groove 33, which is formed along the outer edge of leg section 20 around surfaces 21 and 22. The particular weld configuration may be seen more clearly in FIG. 3 where like numbers represent identical elements.

Each lug member 19 also has rotatably mounted thereon a generally frusto-conical cutter 34 having a plurality of cutting elements or teeth 35 protruding outwardly therefrom. In this particular embodiment the cutter 34 is formed by casting of a high-strength, tough, steel alloy and the teeth 35 are integrally formed thereon. These teeth are generally wide and flat and represent a general chisel shape. Alternatively, the cutters may be formed by forging a frusto-conical cutter blank of sufficient size to include the integral teeth. After the forging operation material is machined away to leave the protruding chisel-shaped teeth.

Figure 7:
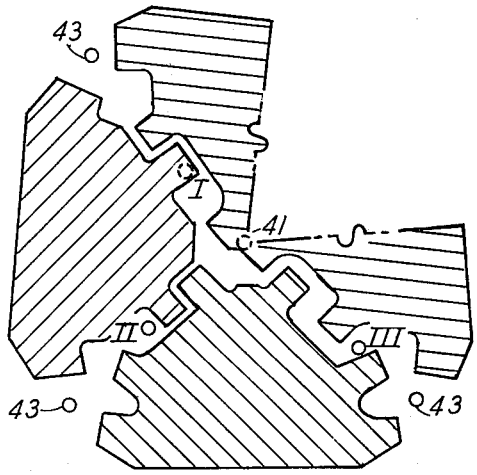
FIG. 7 is a close-up, broken-out view showing the alignment method for assembling the bit.

The embodiment shown in FIG. 1, as mentioned previously, is a tri-cone bit, although only a single lug assembly is shown for simplification reasons. The illustration in FIG. 1 does show the tooth profile of all three cutters of the bit super-imposed upon the single cutter 34. The illustration of cutter 34 is that of the number two cutter on the bit. The teeth of the number one cutter are shown at 36, and the teeth of the number three cutter are shown at 37. Thus, while it was not necessary to show all three of the lug assemblies 18 in order to fully disclose the tri-cone bit since each of the cutters 34 have a different tooth arrangement to allow for better bottomhole coverage and better intermesh of the teeth without interference between adjacent teeth, the profiles of the three cutters are combined to illustrate the total bottomhole tooth coverage. FIG. 7 better illustrates the individual cutter profiles showing the individual spacing relationships of the teeth for each cutter.

One particular feature of the preesent invention is illustrated in FIG. 1 by the lines drawn in phantom thereon. In the lug member 19, an alternate surface 38 is shown drawn in phantom. Likewise, in cutter 34, an alternate gage surface 39 is shown in phantom. These alternate surfaces will be explained in more detail with reference to the description relating to FIG. 4.

In addition to the attachment of lug assembly 18 to body member 11 on platform 15, the body member has additional elements as disclosed in FIG. 1. A plurality of fluid jetting nozzles are located in sufficiently sized openings formed through the central upper portion 40 of body member 11 communicating with central bore 12. The nozzles comprise a single center nozzle 41, a plurality of intermediate nozzles 42, and a plurality of outer nozzles 43. The angular orientation of the intermediate nozzles 42 is shown in relation to a vertical axis $V_1$ drawn through the center of the nozzle 42. One nozzle in this embodiment was placed at an angle of five degrees, the second intermediate nozzle was angled at fifteen degrees, and the third intermediate nozzle was angled at twenty-five degrees from axis $V_1$. Likewise, the angular displacement of the outer nozzles 43 can be shown with respect to a vertical axis $V_2$ drawn through the center of outer nozzle 43. In this particular embodiment, nozzles 43 are angled at 25 degrees from axis $V_2$.

Figure 2:
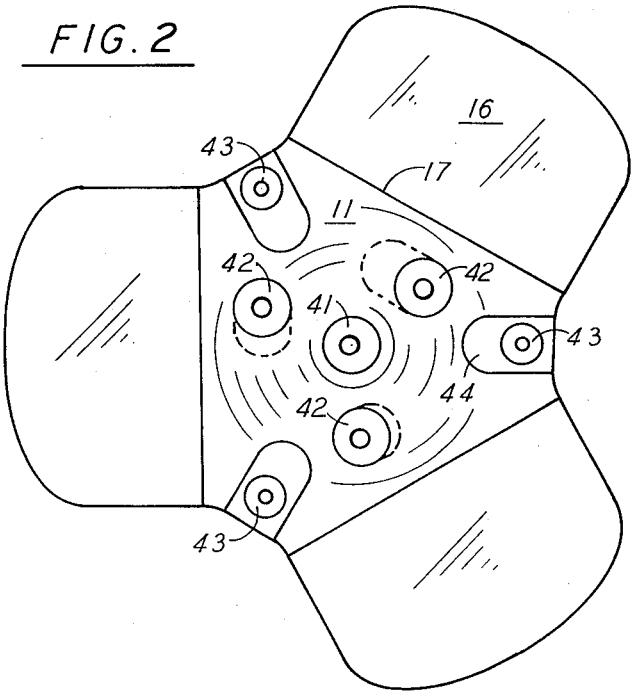
FIG. 2 is an axial view of the cast metal body of the bit prior to the cutter assemblies being joined thereto.

Referring now to FIG. 2, a top view looking down the central rotational axis is illustrated showing the body member 11 prior to assembly of the lug assemblies 18. In FIG. 2 the center nozzle 41, the intermediate nozzles 42 and the outer nozzles 43 are shown in relationship to each other. The outer nozzles 43 are located in recessed areas or valleys 44 formed in body member 11. The angular placement of the intermediate nozzles 42 is indicated by the phantom lines extending downward therefrom which illustrate the location of the nozzle bodies inside their openings which have been cast or machined into body member 11. Nozzles 41, 42 and 43 may be retained in member 11 by any of several alternate methods such as threading, press-fitting, welding and retention by snap rings.

FIG. 5 is a schematic diagram showing a top axial view of body member 11 after the hydraulic nozzle system has been installed but prior to attachment of the lug assemblies 18. The schematic diagram of FIG. 5 illustrates the spiral or sweep pattern of the nozzles as installed. The seven nozzles thus arranged allow the cleaning of different sections of the bit and the borehole, starting with the center nozzle and moving radially outward towards the outer nozzles, which are directed to the gage area being cut in the borehole.

Figure 3:
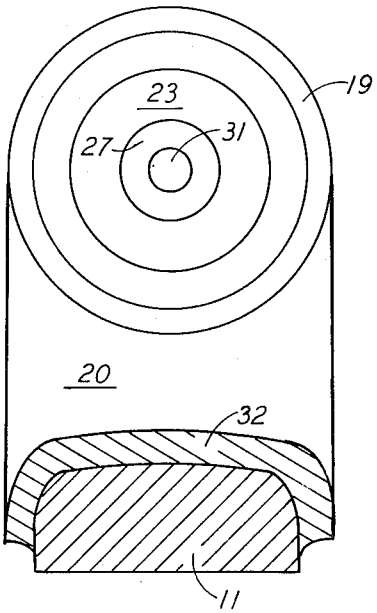
FIG. 3 is a partial schematic drawing taken in a radially outward direction of one cutter assembly illustrating its mounting on the cast bit body.

Referring now to FIG. 3, a radial view of one lug member 19 is disclosed welded in place on body member 11. The cutter 34 has been omitted in order to better illustrate the method of welding the member 19 to member 11. In this embodiment a weld channel has been formed by beveling the outer edges of the lower end 20 of lug member 19 so that weldment may be formed between leg section 20 and platform 16 and 17. The weldment is illustrated in FIG. 3 at 32.

Referring now to FIG. 7, the three typical cutters utilized on the bit of this embodiment have been cross-sectioned and laid out in a profile to illustrate intermesh of the teeth amongst the set of three cutters for one bit. Likewise, FIG. 7 illustrates the placement of the fluidic nozzles with respect to the cutters to show the flow of drilling fluid therebetween. It should be noted that because of the three-dimensional aspect of the cutter placement, the three-dimensional cutter profile indicated in FIG. 7 must involve splitting one of the cutters in half to more realistically define the three-dimensional relationship in a two-dimensional, planar drawing. From FIG. 7 it can be seen that the nozzle system is primarily directed to the intermesh areas between the cutters to better sweep cuttings from the borehole face as they are broken out. It is preferred that no nozzle be directed against a cutter shell because of the inherent problems arising from fluid erosion when the nozzles are directed against the cutter bodies.

Figure 8:
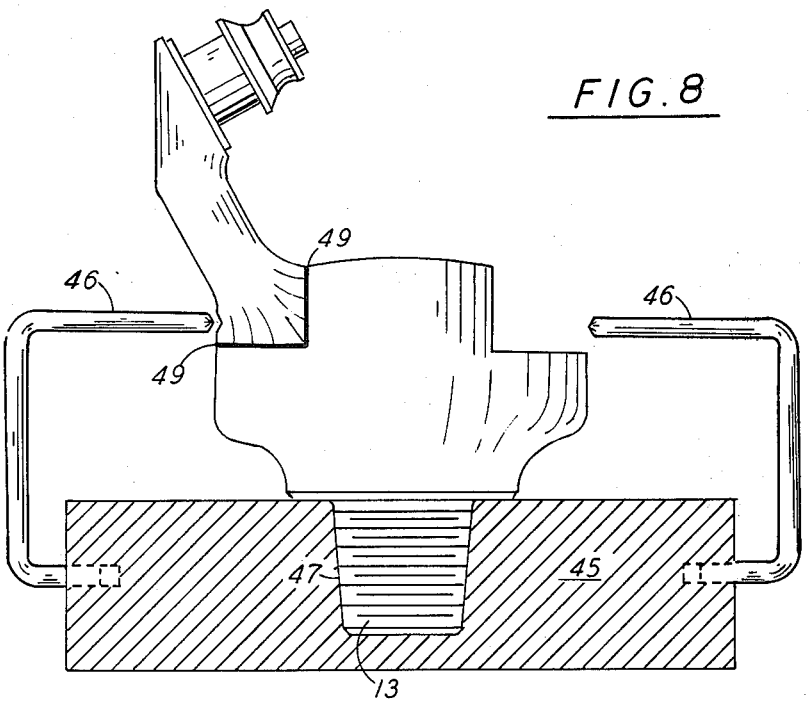
FIG. 8 is a schematic view of the alignment system for assembling the cutter assemblies on the bit body.

FIGS. 6 and 8 illustrate in schematic diagram the system for assembling the lug assemblies on the body member. The system primarily consists of a relatively large, flat base plate 45, having three interspaced sliding alignment arms 46 located thereon, which alignment arms are arranged to be brought into contact with the radially outward portion of leg section 20. The alignment arms 46 are spaced at intervals of 120 degrees around plate 45 from each other when the embodiment of the invention is that of a tri-cone bit. Base plate 45 has a tapered opening 47 for receiving tapered pin section 13 of body member 11. Pin opening 47 may be either internally threaded to match the external threaded portion of pin 13 or may be smooth-walled to receive either the threaded pin end 13 or could be used to receive pin end 13 prior to the threads having been machined thereon. In either instance, opening 47 preferably is dimensioned to snugly fit pin end 13 and secure body member 11 in a rigid, stationary position to accurately locate lug assemblies 18 thereon. The alignment arms 46 are relatively rigid and preferably allowed movement only in a radially outward and inward direction. Movement of arms 46 can be controlled by means well known in the art such as electrical, hydraulic, mechanical or pneumatic.

FIG. 6 is a schematic illustration of a portion of FIG. 8 broken out and enlarged to better illustrate the alignment technique for aligning lug member 19 on platform 15. The end of each alignment arm 46 is formed with a particular geometric configuration such as a right circular cone 47 extending radially inward towards the lug member 19. Likewise, a complementary indentation 48 is formed in lug member 19 to receive the geometric end 47 of arm 46. When such configuration as a conical end 47 and a conical indentation 48 are used, it can be seen that movement radially inward by arm 46 when it contacts the indentation 48 will locate member 19 in an identical position each and every time. Should a misalignment occur, the force of arm 46 moving inward into opening 48 will move member 19 until the geometric end 47 is completely embedded in socket 48, thereby providing proper alignment. At that time should there be spacing between lug member 19 and platform 15, a requisite number of metal shim plates 49 may be inserted prior to welding of lug member 19 on platform 15. It should be noted that although FIG. 8 illustrates a single lug member being attached to the body member, all three such members may be attached simultaneously for optimum alignment of the lug assemblies. It should also be pointed out that the three lug assemblies 18 are completely assembled, including all bearings, seals and cutters, prior to attachment to body member 11 because of the impossibility of attaching the cutters after the lugs 19 have been welded to the body. The lug assemblies 18 have been simplified in FIG. 8 to more clearly illustrate the method of assembly, but in the preferred embodiment, the three lug assemblies 18 in complete assembly form are attached to body member 11 simultaneously by the use of welding techniques in conjunction with alignment system 45.

FIG. 4 illustrates a schematic block diagram showing the versatility of the present invention in forming different sizes of bits using interchangeability of various components. For instance in this particular embodiment, a single body casting 11 can be utilized in forming four different diameter bits. This body casting can be used in a 20-inch bit, 22-inch bit, 24-inch bit and 26-inch bit. In order to manufacture these four sizes of bits, two different lug members 19 are utilized—19*a* and 19*b*. Lug member 19*a* is utilized to form a 20-inch bit and a 22-inch bit. These two bits utilize the same body casting and the same lug, but use different size cutters 34*a* and 34*aa*. Likewise, the two larger bits, the 24-inch diameter and the 26-inch diameter, each use the same body casting 11 and the same lug 19*b*, but likewise use two different cutters 34*b* and 34*bb*. Thus, the manufacture of four different size bits ranging from 20-inch diameter to 26-inch diameter requires only a single type body member, two different types of lugs and four different size cutters.

In addition to this tremendous flexibility and efficiency in assembly, further optimum savings can be obtained by utilizing lug members 19*a* and 19*b*, which are substantially identical except in only a small particular area. For instance, referring back to FIG. 1, the lug member 19*a* of FIG. 4 can be seen in FIG. 1 is defined by the phantom line 38. The larger lug member 19*b* is defined by the outer line of member 19 rather than the phantom line 38. Similarly, optimum efficiency in manufacture of cutters 34 can be achieved by casting the individual cutters and utilizing casting shells that are identical in many respects. The smaller cutters 34*a* and 34*aa* are defined by the phantom lines 39 whereas the larger cutters 34*b* and 34*bb* are defined by the outer lines along the gage surface rather than the phantom lines 39. Thus, by merely changing the gage portion of the cutters at 39 and by changing the radial outward shoulder areas at 38 of the lugs and also by the use of a single body member 11, four different size bits can be manufactured basically using substantially the same amount of tooling and casting equipment as would normally be required in a single diameter bit.

With the great advancements in casting techniques recognized today, such as the investment casting and centrifugal casting methods, the cutters 34 having the integrally formed teeth provide a cutter of identical quality to the conventional method of machining the cutters. Because of the accuracy of modern casting techniques, the cutter dimensions and the teeth configurations are acceptable in the casting and need no machining except in the minor bearing areas internally in the cutter. Preferably, the lug members 19 are forged and machined in the bearing areas because of the strength requirements and the simplicity in forging this relatively uncomplicated shape. The body members 11 preferably are cast in a single operation to form a single, integral body section which is relatively inexpensive to cast and in which the final casting has substantially all of the external dimensions within acceptable tolerances. The only remaining machining is the shoulder areas 15 and in some cases the nozzle bores for the fluidic nozzles 41, 42 and 43. In addition the threaded pin end 13 is machined after the casting. The casting of body member 11 utilizing the known casting techniques is accurate enough that the alignment system 45 can be utilized with the cast pin end 13 even prior to machining of the pin threads thereon.

SUMMARY OF THE INVENTION

The present invention is directed to a multi-cutter, rolling cone drill bit for use in large diameter boreholes, particularly the initial borehole at the top of the drilling operation. These bits are generally of the three-cone configuration and are termed, "top hole" bits. The present invention discloses a top hole bit of extremely accurate external dimensions and a method of manufacturing this bit utilizing flexibility in part selection and interchangeability of parts to provide various sizes of bits from common components. The present invention utilizes an integral cast body rather than the three arcuate segments of the prior art bits. The invention utilizes two sets of forged lugs to provide four sizes of bits.

Likewise, this invention utilizes cast metal cutters rather than machined cutters with four different cutters for the four bit sizes. The two smaller size cutters differ only in the small gage area along the large part of the cone. Also, the two larger diameter bits utilize two different cutter configurations which differ from each other only in the small area added along the gage of the cutter. In addition to these features, the present invention discloses a spiral sweep nozzle arrangement utilizing seven nozzles in a fluidic system which is particularly advantageous in cleaning the entire bottom of the borehole as it is being drilled.

Furthermore, an additional feature and advantage of this invention is the ease and accuracy of the assembly method. The body member is securely attached in a base plate or table to which are slidably attached three alignment arms having geometrical alignment ends for matching engagement in the lug assemblies. It should be noted here that in addition to providing close alignment of the lug assemblies, an easy method of introducing skewed axes into these bits reveals itself with the present alignment system. For instance, if a particular skew dimension in the journal axis is desired, the correlative amount of offset in the alignment indentation 48 can be introduced into each of the lugs such that the alignment arm 46 properly positions each lug to obtain the desired axis skew. Thus, the bit axis skew can be controlled very closely by simply relocating the alignment indentations 48 in each of the lugs. Likewise, proper axial alignment, i.e., height of the cutters above the body member, is easily obtained by the alignment system 46 in conjunction with thin metal shims 49.

In addition to this extremely close control over the height measurements of the three cutter cones, which height control allows a proper weight and wear distribution on each of the three cones, the radial measurements of the three cutters can be held to close tolerances by the same shimming methods along surface 17. Thus, the cutters, by proper shimming on surfaces 16 and 17, will end up properly balanced with respect to load and each sharing proportionately in the cutting of the gage diameter. This greatly reduces rapid wear and failure of the cutter assemblies and provides proper gage cutting action. Thus, it can be seen that the present invention involves large bits and their method of manufacture, which bits offer advanced techniques for ease of assembly and for close control of critical tolerances.

Although certain preferred embodiments of the invention have been herein described in order to provide an understanding of the general principles of the invention, it will be appreciated that various changes and innovations can be effected in the described large diameter, tri-cone drilling bit without departing from these principles. For example, it is obvious that one could alter the number of lug assemblies provided in the bit to include more than the three assemblies illustrated. Also, rather than utilizing cutters which are formed by casting, one could utilize machined cutters instead. The invention, therefore, is declared to cover all changes and modifications of a specific example herein disclosed for purposes of illustration which do not constitute departures from the spirit and scope of the invention.

The embodiments of the invention in which an exclusive property or privilege is claimed are defined as follows:

1. An oil well tricone rolling cutter drilling bit for drilling top hole and large diameter boreholes, said bit comprising:

an integrally formed cast metal body member having a pin end, a central bore passage, and three equispaced platform arms formed thereon;

said platform arms each having a plurality of alignment surface means comprising two different planes for a lug assembly in abutting relationship while permitting vertical, horizontal, and skew adjustment during assembly and adapted to support a lug assembly of a size selected from at least two different sizes;

a lug assembly of a size selected from at least two different sizes welded to each of said platform arms and having a lug member with a leg section at its attachment end and a bearing journal extending radially inwardly at its opposite end; said journal being adapted to support a cutter of a size selected from at least two different sizes; said lug assembly further having a frustoconical cutter of a size selected from at least two different sizes rotatably mounted on said bearing journal by bearing means, and said body member and said lug member forming one of at least two differently sized drilling bits of significantly different diameters.

2. The oil well drilling bit of claim 1 wherein said plurality of alignment surface means on said platform arms comprises a vertical machined surface and an adjacent horizontal machined surface.

3. The oil well drilling bit of claim 1 or claim 2 wherein each said lug assembly further includes an alignment indentation in each said lug member.

4. The oil well drilling bit of claim 1 or claim 2 wherein said cutter comprises an integral cast metal cutter with cast metal teeth protruding therefrom.

5. The oil well drilling bit of claim 1 or claim 2 further comprising a fluid nozzle system containing a plurality of jet nozzles on said body member communicating with said central bore passage and arranged in an angular spiral pattern to sweep a borehole face with fluid jets.

6. The oil well drilling bit of claim 1 or claim 2 further comprising shim means between said lug assemblies and said alignment surface means arranged to provide said vertical, horizontal and skew adjustment among said lug assemblies with respect to said body member.

7. The oil well drilling bit of claim 1 in which said platform arms each includes an L-shaped machined alignment surface thereon;

each said lug assembly includes a cast steel frustoconical cutter rotatably mounted on said bearing journal by bearing means;

a spiral sweep nozzle system comprising a plurality of jet nozzles on said body member at the end opposite said pin end, arranged to communicate fluidically with said bore passage and adapted to spray a fluid sweep against a borehole face being drilled.

* * * * *